US009637899B2

(12) United States Patent
Ping et al.

(10) Patent No.: US 9,637,899 B2
(45) Date of Patent: May 2, 2017

(54) VACUUM BREAKER, AUTOMATIC FLUSHING SYSTEM FOR TOILET AND ELECTRONIC BIDET TOILET

(71) Applicant: DURAVIT AKTIENGESELLSCHAFT, Hornberg (DE)

(72) Inventors: Zhixiong Ping, Shanghai (CN); Weimin Ying, Shanghai (CN)

(73) Assignee: DURAVIT AKTIENGESELLSCHAFT, Hornberg (DE)

( * ) Notice: Subject to any disclaimer, the term of this patent is extended or adjusted under 35 U.S.C. 154(b) by 418 days.

(21) Appl. No.: 14/192,279

(22) Filed: Feb. 27, 2014

(65) Prior Publication Data

US 2014/0245532 A1 Sep. 4, 2014

(30) Foreign Application Priority Data

Mar. 1, 2013 (CN) ..... 2013 2 0093841 U

(51) Int. Cl.

| | |
|---|---|
| ***E03D 5/02*** | (2006.01) |
| ***E03D 9/08*** | (2006.01) |
| ***E03C 1/10*** | (2006.01) |

(52) U.S. Cl.

CPC ..... *E03D 5/022* (2013.01); *E03C 1/108* (2013.01); *E03D 9/08* (2013.01)

(58) Field of Classification Search

CPC ..... E03D 9/08; E03D 5/022; E03C 1/108
See application file for complete search history.

(56) References Cited

U.S. PATENT DOCUMENTS 2,247,525 A * 7/1941 Sherwood ..... E03C 1/108 137/217
2,294,092 A * 8/1942 Moody ..... A01G 25/16 137/217

(Continued)

FOREIGN PATENT DOCUMENTS

CN 102378843 A 3/2012
EP 2 192 242 A2 6/2010

(Continued)

OTHER PUBLICATIONS

Office action dated Aug. 21, 2015 for Taiwanese Application No. 104-1(6)05201-10421120690 and English translation.

(Continued)

*Primary Examiner* — Craig Schneider
*Assistant Examiner* — Kevin Barss
(74) *Attorney, Agent, or Firm* — Lucas & Mercanti, LLP

(57) ABSTRACT

The present utility model relates to a vacuum breaker, an automatic flushing system for toilet having the vacuum breaker, and an electric bidet toilet having the automatic flushing system for toilet. The vacuum breaker comprises a body and a cover which cooperate to define a cavity, the body being integrally formed with an inlet pipe section which defines a water inlet and an outlet pipe section which defines a water outlet, the cover being formed with an air port, wherein a tip portion of the inlet pipe section extends into the cavity in a direction towards the air port. The length of the tip portion of the inlet pipe section which extends within the cavity is greater than half of the height of the cavity. According to the present utility model, because the tip portion of the inlet pipe section extends almost throughout the cavity of the vacuum breaker, the level of the water inlet is elevated, so that the CL (critical level) line is raised.

8 Claims, 3 Drawing Sheets

(56) References Cited

U.S. PATENT DOCUMENTS

| | | | | | |
|---|---|---|---|---|---|
| 2,730,117 | A | | 1/1956 | Bennett | |
| 2,927,598 | A | * | 3/1960 | Thompson | E03C 1/104 137/218 |
| 3,713,457 | A | * | 1/1973 | McInnis | F16K 1/34 137/218 |
| 4,712,575 | A | * | 12/1987 | Lair | E03C 1/108 137/218 |
| 4,761,836 | A | | 8/1988 | Tsutsui | |
| 5,038,814 | A | | 8/1991 | Gayton | |
| 5,060,687 | A | * | 10/1991 | Gayton | E03C 1/104 137/218 |
| 2007/0240765 | A1 | * | 10/2007 | Katzman | E03B 7/077 137/218 |
| 2010/0077544 | A1 | * | 4/2010 | Okubo | E03D 5/01 4/354 |
| 2012/0012193 | A1 | | 1/2012 | Song | |

FOREIGN PATENT DOCUMENTS

| | | |
|---|---|---|
| JP | 200034762 | 8/2001 |
| JP | 200952671 | 9/2010 |
| KR | 1991-0005099 | 7/1991 |
| KR | 20-0243417 | 10/2001 |
| KR | 10-2010-0109245 | 10/2010 |

OTHER PUBLICATIONS

Korean Office Action for related Korean Application No. 10-2013-0090075, issued Jul. 30, 2014.
English translation of D1.
English translation of Japanese Office Action dated Aug. 19, 2014.

* cited by examiner

VACUUM BREAKER, AUTOMATIC FLUSHING SYSTEM FOR TOILET AND ELECTRONIC BIDET TOILET

CROSS-REFERENCE TO RELATED APPLICATIONS

This application claims the priority of CN 201320093841.2 filed Mar. 1, 2013 which is incorporated by reference herein.

TECHNICAL FIELD

The present utility model relates to an electric bidet toilet (EBT), and in particular to a vacuum breaker provided in an automatic flushing system for the EBT.

In an automatic flushing system for EBT, a vacuum breaker is disposed in a water inlet pipe to prevent reflux of waste water caused by negative pressure in the pipe. FIG. 1 shows a vacuum breaker 100 applied in an automatic flushing system for toilet. The vacuum breaker 100 comprises a body 101 and a cover 102 which cooperate to define a cavity 103. A water inlet 104 and a water outlet 105 are formed in the body 101. An air port 106 and an overflow hole 107 in communication therewith are formed in the cover 102. A gasket 108 and a gasket fixation shaft 109 are disposed within the cavity 103. When a negative pressure occurs in the water inlet pipe, external air is introduced into the cavity 103 through the air port 106, such that the gasket 108 closes the water inlet 104 so as to prevent the waste water from refluxing into the water inlet pipe. A waterproof cap 110 is disposed above the cover 102 to prevent a splash of water from the air port 106 and the overflow hole 107.

In the vacuum breaker 100 shown in FIG. 1, a tip portion (upper end portion) of an inlet pipe section which defines the water inlet 104 is substantially level, with a bottom of the cavity 103 and does not extend further into the cavity 103, and a substantial portion of the gasket fixation shaft 109 is above the gasket 108. This structure results in a low critical level (CL) line of the toilet, makes it difficult to meet the requirement of certifications, such as cUPC certification, and brings about a large volume of the vacuum breaker. In addition, the waterproof cap 110 is separately molded and then assembled to the cover 102, which increases manufacturing and assembling cost.

An objective of the present utility model is to provide a vacuum breaker applicable in an automatic flushing system for toilet, which can raise the CL line during refluxing so as to meet the requirement of certifications. Another objective of the present utility model is to reduce the size of the vacuum breaker. A further objective of the present utility model is to reduce the cost of the vacuum breaker.

A first aspect of the present utility model provides a vacuum breaker comprising a body and a cover which cooperate to define a cavity, the body being integrally formed with an inlet pipe section which defines a water inlet and an outlet pipe section which defines a water outlet, the cover being formed with an air port, wherein a tip portion of the inlet pipe section extends into the cavity in a direction towards the air port.

Preferably, the length of a portion of the inlet pipe section which extends within the cavity is greater than half of the height of the cavity. More preferably, the tip portion of the inlet pipe section extends within the cavity up to the proximity of the air port.

Preferably, the vacuum breaker further comprises a gasket movable between a first position for closing the water inlet and a second position for closing the air port and a gasket fixation shaft for fixing the gasket, the gasket fixation shaft extending downward into the inlet pipe section.

In a favorable embodiment, the cover is integrally formed with a waterproof cap located above the air port.

In another favorable embodiment, the vacuum breaker is further provided with an overflow hole in communication with the air port, and the cover is integrally formed with a waterproof sheet located above the overflow hole.

In a further favorable embodiment, the vacuum breaker is further provided with an overflow hole in communication with the air port, and the cover is integrally formed with a waterproof cap located above the air port and a waterproof sheet located above the overflow hole.

A second aspect of the present utility model provides art automatic flushing system for toilet comprising any one of the above vacuum breakers.

A third aspect of the present utility model provides an EBT having the above automatic flushing system for toilet.

According to the present utility model, as compared with the prior art in which the tip portion of the inlet pipe is substantially level with the bottom of the cavity of the vacuum breaker, because the tip portion of the inlet pipe section extends into the cavity in a direction towards the air port, the level of the water inlet is elevated, so that the CL line during reaming is raised. The greater the length of the portion of the inlet pipe section extending within the cavity is, the higher the CL line is, so that it is easier to meet the requirement of certifications.

In addition, the size of the vacuum breaker is reduced by arranging the gasket fixation shaft to extend downward into the inlet pipe section.

Also, the cost is reduced and assembling process is simplified by integrally forming the cover of the vacuum breaker with the waterproof cap located above the air port and/or the waterproof sheet located above the overflow hole.

DETAILED DESCRIPTION OF PREFERRED EMBODIMENTS

Figure 2:
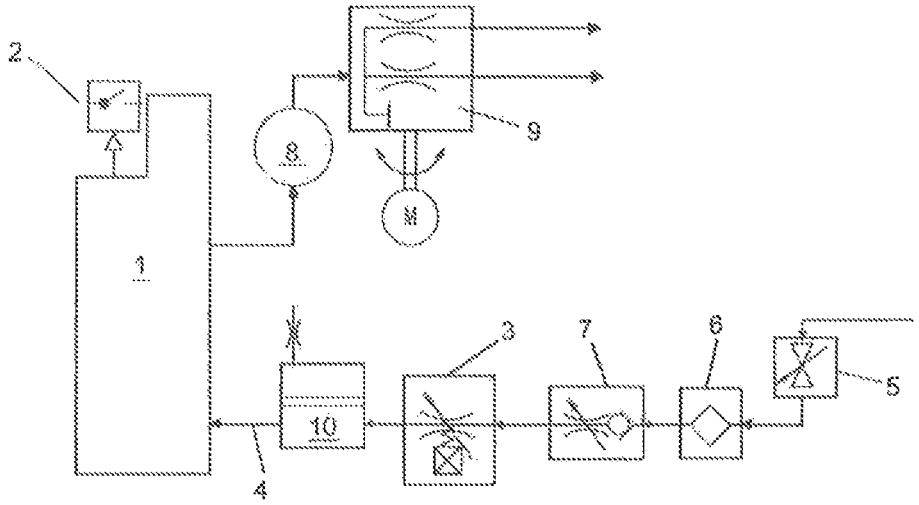
FIG. 2 is a schematic view of an automatic flushing system for toilet according to an embodiment of the present utility model.

FIG. 2 schematically shows an automatic flushing system for toilet according to an embodiment of the present utility model. The automatic flushing system for toilet according to the present utility model may be applied to an EBT capable of automatically flushing after use of the toilet by a user. For example, an infrared inductive probe may be provided on the front side wall of water tank to initiate flushing when detecting that the user has just left after using the toilet. As an alternative, a pressure sensor may be provided at the bottom of the toilet seat to detect seating on the toilet seat and leaving of a user and to accordingly initiate flushing.

The automatic flushing system for toilet comprises a tank 1. As shown in FIG. 2, a float switch 2, which is connected with a float inside the tank 1, is attached to the tank 1. After flushing, water level in the tank 1 is lowered and the float accordingly drops due to the gravity. Then, the float switch 2 is turned on and an electromagnetic inlet valve 3 is correspondingly opened, and tap water from a water supply pipe flows into the tank 1 through a water inlet line 4. With increase of water inside the tank 1, the float rises as the floating force overcomes the gravity force. When the float rises up to a predetermined water level, the float switch 2 is turned off and the electromagnetic inlet valve 3 is correspondingly closed, and water inflow of the tank 1 is stopped.

A master shutoff valve 5, a filter 6 and a non-return flux valve 7 are disposed between the water supply line and the electromagnetic inlet valve 3. A flushing port of the tank 1 is connected to a distribution valve 9 via a pressure pump 8. The distribution valve 9 switches water from the tank 1 under control of a stepper motor M, such that the water selectively flows to a rim outlet or a jet outlet of the toilet bowl. The structures and functions of these components are well-known to those skilled in the art and thus detailed description thereof is omitted herein.

Figure 3:
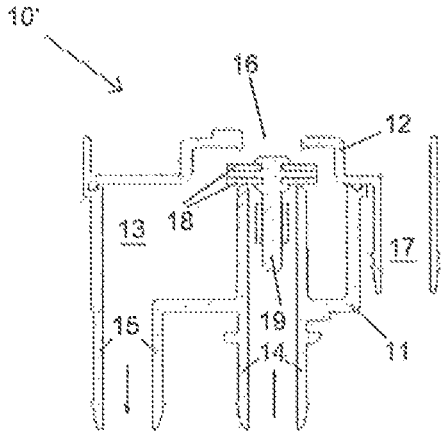
FIG. 3 is a schematic sectional view of a vacuum breaker according to an embodiment of the present utility model.
Figure 4:
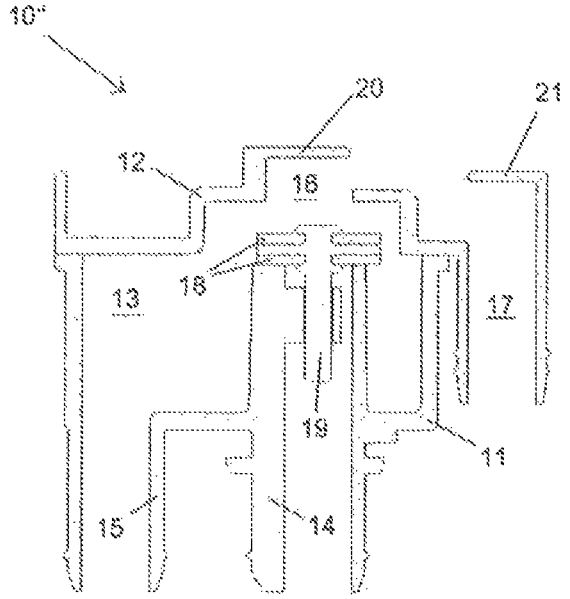
FIG. 4 is a schematic sectional view of a vacuum breaker according to another embodiment of the present utility model.
Figure 5:
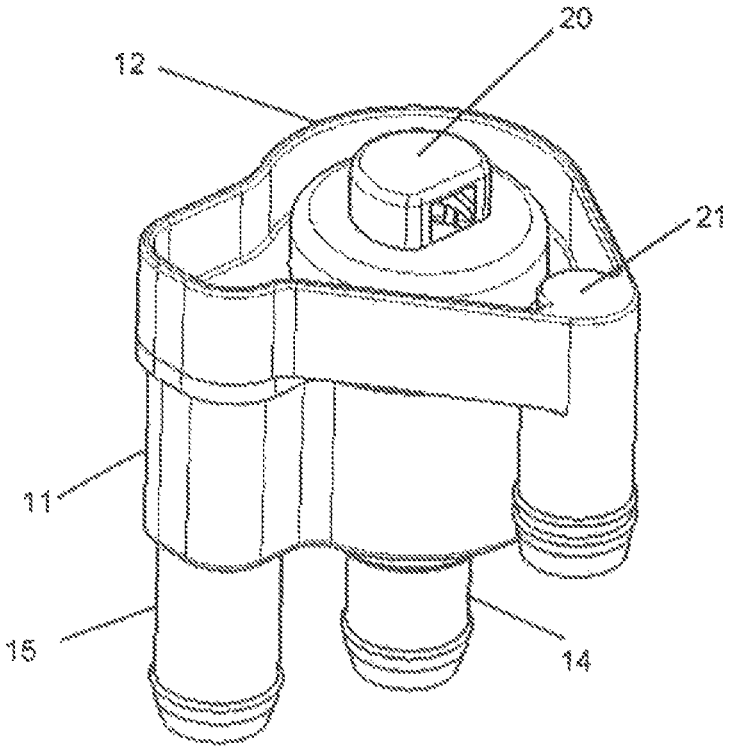
FIG. 5 is a perspective view of the vacuum breaker of FIG. 4.

In order to prevent reflux of waste water in the water inlet line 4 when a negative pressure occurs due to various reasons, a vacuum breaker 10 is disposed in the water inlet line 4. With reference to FIGS. 3-5, two schematic embodiments of the vacuum breaker of the present utility model will be described in detail below.

In the embodiment shown in FIG. 3, a vacuum breaker 10' includes a body 11 and a cover 12. The body 11 and the cover 12 cooperate to define a cavity 13. The body 11 is formed with an inlet pipe section 14 which defines a water inlet and which can be connected with a water inlet hose downstream of the electromagnetic valve 3, and an outlet pipe section 15 which defines a water outlet and which can be connected with a hose leading to the tank 1. An air port 16 and an overflow hole 17 in communication with the air port 16 are formed in the cover 12. Superfluous water in the vacuum breaker 10' may flow to the jet outlet or the rim outlet of the toilet bowl via the overflow hole 17 and an overflow line connected thereto. A gasket 18 movable between a first position for closing the water inlet and a second position for closing the air port 16 and a gasket fixation shaft 19 for fixing the gasket 18 are disposed within the cavity 13.

The vacuum breaker 10' works in the same way as the vacuum breaker of the prior art. Normally, the gasket 18, due to its gravity and gravity of the gasket fixation shaft 19, abuts against the upper end of the inlet pipe section 14. When water is required to flow into the tank 1, the electromagnetic inlet valve 3 is opened, and the pressure of tap water urges the gasket 18 and the gasket fixation shaft 19 to move upward, so as to open the water inlet and close the air port 16. The tap water flowing into the cavity 13 via the water inlet flows out via the water outlet and into the tank 1. When negative pressure occurs in the water inlet line, external air is introduced into the cavity 13 via the air port 16 so as to prevent a siphon phenomenon, and air pressure presses the gasket 18 against the upper end the inlet pipe section to close the water inlet. Thus, it is possible to effectively prevent waste water from refluxing to the water inlet line.

Figure 1:
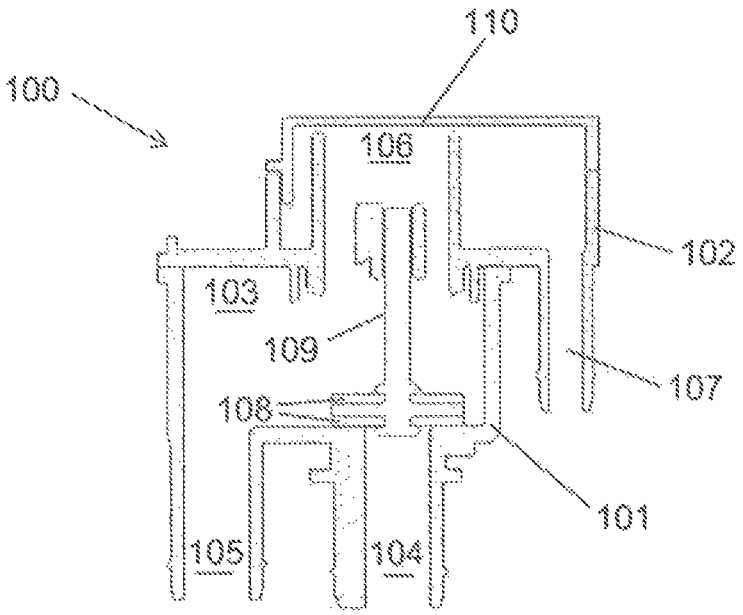
FIG. 1 PRIOR ART
FIG. 1 is a schematic sectional view of a vacuum breaker of prior art.

As shown in FIG. 3, the tip portion (i.e. upper end portion) of the inlet pipe section 14 of the vacuum breaker 10' extends almost throughout the cavity 13 up to the proximity of the air port 16. As compared with the vacuum breaker 100 shown in FIG. 1, the level of the water inlet is elevated, so that the CL line during refluxing is raised.

In addition, because the gasket fixation shaft 19 is arranged in such a manner that a substantial portion of the gasket fixation shaft. 19 extends downward into the inlet pipe section 14, the size of the vacuum breaker 10' is reduced. Moreover, as compared with the vacuum breaker 100 shown in FIG. 1, it is easy to form structures on an inner wall of the inlet pipe section 14 to guide and support the gasket fixation shaft 19, for example, a plurality of ribs which are circumferentially spaced.

The vacuum breaker 10" shown in FIG. 4 differs from the vacuum breaker 10' shown in FIG. 3 mainly in that a waterproof cap 20 is disposed above the air port 16 and a waterproof sheet 21 is disposed above the overflow hole 17, so that water splashing from the air port 16 or the overflow hole 17 can be reliably prevented. Unlike the waterproof cap 110 separately molded from the cover 102 in the vacuum breaker 100 of FIG. 1, the waterproof 20 and the waterproof sheet 21 in this embodiment are integrally formed with the cover 12 of the vacuum breaker 10". Thus, manufacturing cost is reduced, and a step of assembling the waterproof cap or waterproof sheet onto the cover of the vacuum breaker is omitted.

FIG. 5 is a perspective view of the vacuum breaker 10" shown in FIG. 4, illustrating the entire structure of the vacuum breaker. The perspective view of the vacuum breaker 10' (which does not have the waterproof cap 20 and the waterproof sheet 21) shown in FIG. 3 is easily conceivable from FIG. 5.

Although both the waterproof cap 20 and the waterproof sheet 21 are provided in the embodiment of FIGS. 4 and 5, it is possible to integrally form only one of the waterproof cap 20 and the waterproof sheet 21 on the cover 12.

In each of the above embodiments, the tip portion (i.e. upper end portion) of the inlet pipe section 14 of the vacuum breaker extends almost throughout the cavity 13 up to the proximity of the air port 16. However, the present utility model is not limited to this. As compared with the prior art, the technical effects of raising the CL line can be achieved as long as the tip portion of the inlet pipe section 14 extends at a distance within the cavity 13 in a direction towards the air port 16. For instance, the length of a portion of the inlet pipe section which extends within the cavity may be greater than half of the height of the cavity.

While the preferred embodiments of the present utility model have been described hereinabove, they shall not be construed as limiting or restricting this utility model, and various improvements and modifications may be made by those skilled in a the art without departing from the scope of the present utility model. Other embodiments can also be obtained by those skilled in the art with reference to the disclosure herein. The description and the embodiments shall be considered as exemplary only, and the true scope of this utility model is defined by the annexed claims and their equivalents.

The invention claimed is:

1. A vacuum breaker, comprising:

a body and a cover which cooperate to define a cavity, the body being integrally formed with an inlet pipe section which defines a water inlet and an outlet pipe section which defines a water outlet, the cover being formed with an air port, wherein a tip portion of the inlet pipe section extends into the cavity in a direction towards the air port; and a gasket movable between a first position for closing the water inlet and a second position for closing the air port and a gasket fixation shaft for fixing the gasket, the gasket fixation shaft extending downward into the inlet pipe section and parallel with an axis of the inlet pipe section.

2. The vacuum breaker according to claim 1, wherein the length of a portion of the inlet pipe section which extends within the cavity is greater than half of the height of the cavity.

3. The vacuum breaker according to claim 2, wherein the tip portion of the inlet pipe section extends within the cavity up to the proximity of the air port.

4. The vacuum breaker according to claim 1, wherein the cover is integrally formed with a waterproof cap located above the air port.

5. The vacuum breaker according to claim 1, wherein an overflow hole in communication with the air port is further provided, wherein the cover is integrally formed with a waterproof sheet located above the overflow hole.

6. The vacuum breaker according to claim 1, wherein an overflow hole in communication with the air port is further provided, wherein the cover is integrally formed with a waterproof cap located above the air port and a waterproof sheet located above the overflow hole.

7. An automatic flushing system for toilet, comprising a vacuum breaker according to claim 1.

8. An electronic bidet toilet, having an automatic flushing system for toilet according to claim 7.

* * * * *